US006145724A

United States Patent [19]

Shkolnikov et al.

[11] Patent Number: 6,145,724

[45] **Date of Patent: *Nov. 14, 2000**

[54] COMBUSTION POWERED TOOL WITH COMBUSTION CHAMBER DELAY

[75] Inventors: Yury Shkolnikov, Glenview; James W. Robinson, Mundelein; Tony Deieso, Wadsworth, all of Ill.

[73] Assignee: Illinois Tool Works, Inc., Glenview, Ill.

[ * ] Notice: This patent is subject to a terminal disclaimer.

[21] Appl. No.: 09/315,587

[22] Filed: May 20, 1999

Related U.S. Application Data

[63] Continuation-in-part of application No. 08/961,811, Oct. 31, 1997, Pat. No. 5,909,836.

[51] Int. Cl.[7] ..... B25C 1/04; B25C 1/08

[52] U.S. Cl. ..... 227/8; 227/130; 227/10

[58] Field of Search ..... 227/8, 7, 130, 227/9, 10, 123; 123/465 C; 60/636, 635

[56] References Cited

U.S. PATENT DOCUMENTS

| | | | |
|---|---|---|---|
| Re. 27,628 | 5/1973 | Newton et al. | 227/8 |
| 3,042,008 | 7/1962 | Liesse | 123/465 C |
| 3,567,098 | 3/1971 | Maynard | 227/8 |
| 3,677,456 | 7/1972 | Ramspeck et al. | 227/130 |
| 3,809,307 | 5/1974 | Wandel et al. | 227/8 |
| 3,942,700 | 3/1976 | Maier | 227/8 |
| 3,964,659 | 6/1976 | Eiben et al. | 227/8 |
| 3,967,771 | 7/1976 | Smith | 227/10 |
| 4,006,786 | 2/1977 | Speicher | 227/8 |
| 4,211,353 | 7/1980 | Aunis | 227/8 |
| 4,480,528 | 11/1984 | Shiroyama | 227/130 |
| 4,483,473 | 11/1984 | Wagdy | 227/8 |
| 4,483,474 | 11/1984 | Nikolich | 227/8 |
| 4,629,106 | 12/1986 | Howard et al. | 227/8 |
| 4,717,060 | 1/1988 | Cotta | 227/10 |
| 4,739,915 | 4/1988 | Cotta | 227/10 |
| 5,191,861 | 3/1993 | Kellerman et al. | 123/46 SC |
| 5,197,646 | 3/1993 | Nikolich | 227/8 |
| 5,213,247 | 5/1993 | Gschwend et al. | 227/10 |
| 5,485,946 | 1/1996 | Jankel | 227/8 |
| 5,671,880 | 9/1997 | Ronconi | 227/130 |
| 5,680,980 | 10/1997 | Robinson | 227/10 |
| 5,687,897 | 11/1997 | Fa et al. | 227/8 |
| 5,909,836 | 6/1999 | Shkolnikov et al. | 227/8 |

*Primary Examiner*—Peter Vo
*Assistant Examiner*—Jim Calve
*Attorney, Agent, or Firm*—Greer, Burns & Crain, Ltd.

[57] ABSTRACT

A combustion powered tool has a self-contained internal combustion power source constructed and arranged for creating a combustion for driving a driver blade to impact a fastener and drive it into a workpiece. The tool includes a housing constructed and arranged to enclose the power source, a combustion chamber defined at an upper end of the housing and a cylinder disposed be in fluid communication with the combustion chamber. A valve member is disposed to periodically close the combustion chamber. A piston is associated with the driver blade and is configured for reciprocal movement within the cylinder between a start position and a driving position. Also included on the tool is a nosepiece having a workpiece contact element configured for contacting a workpiece. The workpiece contact element is movable relative to the nosepiece, and upon such contact, the movement of the workpiece contact element causes the valve member to close the combustion chamber. A delay apparatus is engageable with the workpiece contact element and the linkage for delaying the opening of the combustion chamber by the valve member until the piston returns to the start position after driving the fastener.

17 Claims, 7 Drawing Sheets

66
160
182
220
218
202
212
174
194
172
170
180
190
222
213

COMBUSTION POWERED TOOL WITH COMBUSTION CHAMBER DELAY

RELATED APPLICATION

This application is a Continuation-In-Part of U.S. Ser. No. 08/961,811, filed Oct. 31, 1997 and entitled COMBUSTION POWERED TOOL WITH COMBUSTION CHAMBER LOCKOUT now U.S. Pat. No. 5,909,836.

BACKGROUND OF THE INVENTION

The present invention relates generally to improvements in portable combustion powered fastener driving tools, and specifically to improvements relating to the retarding of the post-combustion opening of the combustion chamber to allow the piston to properly return to the start position.

Portable combustion powered, or so-called IMPULSE® brand tools for use in driving fasteners into workpieces are described in commonly assigned patents to Nikolich U.S. Pat. Re. No. 32,452, and U.S. Pat. Nos. 4,552,162; 4,483,473; 4,483,474; 4,403,722 and 5,263,439, all of which are incorporated by reference herein. Similar combustion powered nail and staple driving tools are available commercially from ITW-Paslode of Lincolnshire, Ill. under the IMPULSE® brand.

Such tools incorporate a generally pistol-shaped tool housing enclosing a small internal combustion engine. The engine is powered by a canister of pressurized fuel gas, also called a fuel cell. A powerful, battery-powered electronic power distribution unit produces the spark for ignition, and a fan located in the combustion chamber provides for both an efficient combustion within the chamber, and facilitates scavenging, including the exhaust of combustion by-products. The engine includes a reciprocating piston with an elongate, rigid driver blade disposed within a cylinder body.

A valve sleeve is axially reciprocable about the cylinder and, through a linkage, moves to close the combustion chamber when a workpiece contact element at the end of the linkage is pressed against a workpiece. The workpiece contact element is designed to reciprocate relative to a nosepiece, which is fixed to the housing. This pressing action also triggers a fuel metering valve to introduce a specified volume of fuel into the closed combustion chamber.

Upon the pulling of a trigger switch, which causes the ignition of a charge of gas in the combustion chamber of the engine, the piston and driver blade are shot downward to impact a positioned fastener and drive it into the workpiece. The piston then returns to its original, or "ready" position through differential gas pressures within the cylinder. Fasteners are fed magazine-style into the nosepiece, where they are held in a properly positioned orientation for receiving the impact of the driver blade.

One of the design criteria for conventional combustion tools is that the trigger cannot be operated until the nosepiece is pressed against the workpiece. This feature delays ignition until the combustion chamber is closed. A suitable trigger lockout mechanism is disclosed in U.S. Pat. No. 4,483,474, which is incorporated by reference. In the '474 patent, a cam and lever mechanism prevent depression of the trigger until the nosepiece is pressed against the workpiece, closing the combustion chamber. Upon firing, the combustion chamber cannot open until the trigger is released.

A recent development in combustion tools is the creation of high energy tools which produce more force for driving the fasteners into the workpiece. In some such tools, the additional force is obtained through the use of an extended cylinder through which the piston travels, thus providing the piston with a longer stroke. In other higher energy designs, the volume of the combustion chamber is increased. In these designs, the increased surface area of the combustion chamber is attempted to be minimized, and the surface area of the cylinder may remain the same. There is more combustion energy, but not equivalently more surface area for cooling and creating the differential pressure to return the piston to the start position. Accordingly, the piston returns more slowly.

In longer length tools, the time required for the return of the piston is increased as the length of the cylinder increases. It has been found that in some relatively recently-developed high energy combustion tools, the piston requires approximately twice as long to return to its start position as in conventional combustion tools having a relatively shorter stroke. Obviously, the tool should not be fired until the piston has been completely returned to the start position.

In combustion tools equipped as described above, in the event that the trigger switch is released and the tool lifted from the workpiece before the piston has returned to its start position, the valve linkage allows the combustion chamber to open, thus destroying the differential gas pressures which assist in the upward return of the piston. In order to have consistent firings, the size of the combustion chamber must always be the same.

Another design criteria for combustion tools of this type is the desire for operators working on construction sites to practice what is commonly referred to as "bump firing". This is a procedure of rapid firing of the tool such that the operator utilizes the recoil of the firing of a first fastener to lift the tool and rapidly place it in position for the next firing. As such, there is a shorter period of time in which the tool is maintained with the nosepiece and the workpiece contact element pressed against the workpiece. To prevent misfires, the tool must be allowed to recover between firings by the piston returning to the start position before a subsequent ignition. For proper piston return, the combustion chamber must remained sealed until the piston reaches the start position.

Accordingly, it is an object of the present invention to provide an improved combustion powered tool which prolongs the scaled condition in the combustion chamber until the piston has returned to its pre-combustion start position.

Another object of the present invention is to provide an improved combustion powered tool which features a mechanism for keeping the combustion chamber closed until the piston returns to its start position.

A further object of the present invention is to provide an improved combustion powered tool wherein the combustion chamber is kept closed until the return of the piston by a mechanism which delays the release of the trigger switch, and, through connection to the lockout mechanism, thus ultimately delays the opening of the combustion chamber.

An additional object of the present invention is to provide an improved combustion powered tool featuring a trigger switch which is relatively easier to depress or activate than it is to return to its initial, non-activated position.

Still another object of the present invention is to provide an improved combustion powered tool featuring a lockout mechanism which temporarily prevents movement of the workpiece contact element relative to the nosepiece, and thus maintains the combustion chamber in a closed position until the piston returns to the start position.

BRIEF SUMMARY OF THE INVENTION

The above-listed objects are met or exceeded by the present improved combustion powered fastener tool, which features a delay apparatus for delaying the opening of the combustion chamber post-combustion until the piston has returned to its start position. In a first embodiment, the tool is provided with a trigger-operated combustion chamber lockout mechanism which prevents the unwanted opening of the combustion chamber until the trigger is released after firing. The delay apparatus retards the movement of the trigger from the ON position to the OFF position, thus providing additional time for the piston to return to the start position. In another embodiment, the delay apparatus prevents unwanted advanced opening of the combustion chamber by preventing movement of the valve member. The valve member is controlled by temporarily locking the workpiece contact element relative to the nosepiece until the piston returns to the start position.

More specifically, the present invention provides a combustion powered tool having a self-contained internal combustion power source constructed and arranged for creating a combustion for driving a driver blade to impact a fastener and drive it into a workpiece. The tool includes a housing constructed and arranged to enclose the power source, a combustion chamber defined at an upper end of the housing and a cylinder disposed in the housing to be in fluid communication with the combustion chamber. A valve member is disposed in the housing to periodically open and close the combustion chamber. A piston is associated with the driver blade and is configured for reciprocal movement within the cylinder between a start position located at a first end of the cylinder and a driving position located at a second end of the cylinder. Also included on the tool is a nosepiece having a workpiece contact element connected to the valve member and configured for contacting a workpiece into which a fastener is to be driven. The workpiece contact element is movable relative to the nosepiece, and upon such contact, the movement of the workpiece contact element causing the valve member to close the combustion chamber. A delay apparatus is engageable with the workpiece contact element and the linkage for delaying the opening of the combustion chamber by the valve member until the piston returns to the start position after driving the fastener.

DETAILED DESCRIPTION OF THE INVENTION

Figure 1:
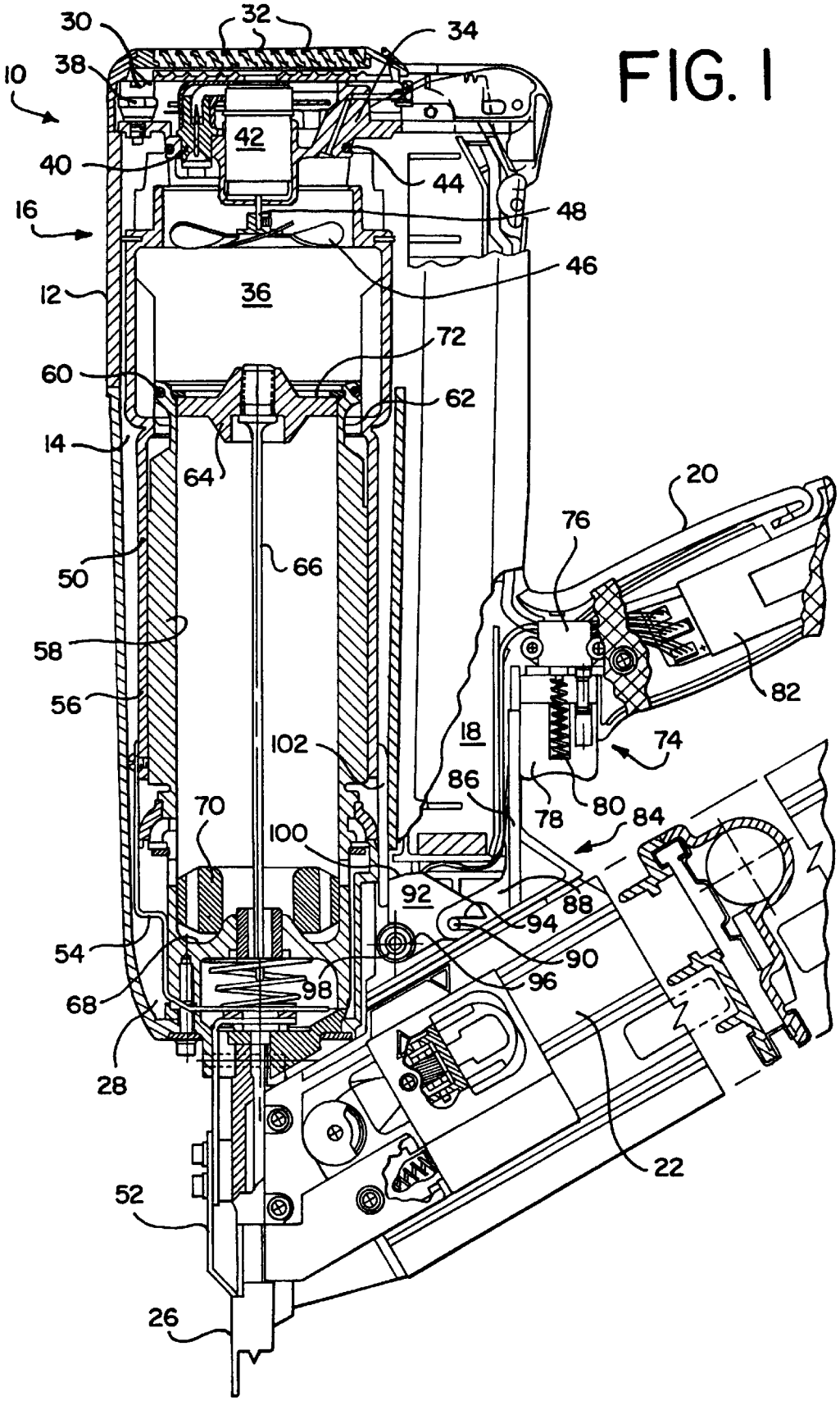
FIG. 1 is a fragmentary side view of a combustion powered fastener tool in accordance with the present invention shown with the combustion chamber open and the trigger in the OFF position, the tool being partially cut away for purposes of clarity.
Figure 2:
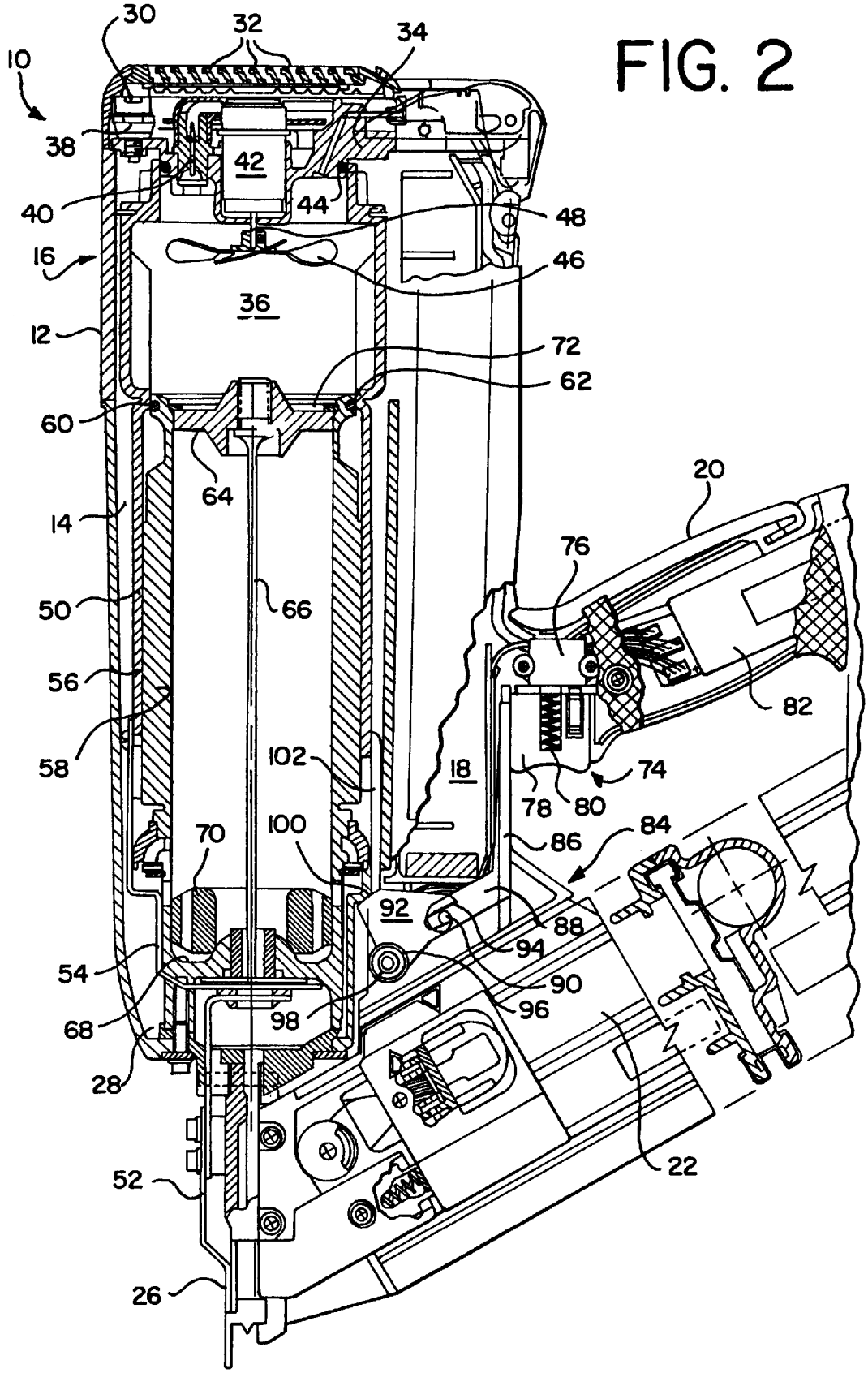
FIG. 2 is a fragmentary side view of the combustion powered fastener tool of FIG. 1 shown in with the combustion chamber closed and the trigger in the ON position, the tool being partially cut away for purposes of clarity.

Referring now to FIGS. 1 and 2, a combustion-powered tool of the type suitable for use with the present invention is generally designated 10. The tool 10 has a housing 12 including a main power source chamber 14 dimensioned to enclose a self-contained internal combustion power source 16, a fuel cell chamber 18 generally parallel with and adjacent the main chamber 14, and a handle portion 20 extending from one side of the fuel cell chamber and opposite the main chamber.

In addition, a fastener magazine 22 is positioned to extend generally parallel to the handle portion 20 from an engagement point with a nosepiece 26 depending from a first or lower end 28 of the main chamber 14. A battery (not shown) is provided for providing electrical power to the tool 10, and is releasably housed in a tubular compartment (not shown) located on the opposite side of the housing 12 from the fastener magazine 22.

As used herein, "lower" and "upper" are used to refer to the tool 10 in its operational orientation as depicted in FIGS. 1 and 2; however it will be understood that this invention may be used in a variety of orientations depending on the application. Opposite the lower end 28 of the main chamber is a second or upper end 30, which is provided with a plurality of air intake vents 32.

In a preferred embodiment, an electromagnetic, solenoid-type fuel metering valve (not shown) or an injector valve of the type described in commonly-assigned U.S. Pat. No. 5,263,439 is provided to introduce fuel into the combustion chamber as is known in the art. The above-identified U.S. Pat. No. 5,263,439 is incorporated by reference. A pressurized liquid hydrocarbon fuel, such as MAPP, is contained within a fuel cell located in the fuel cell chamber 18 and pressurized by a propellant as is known in the art.

Returning to the main chamber 14, a cylinder head 34 is disposed at the upper end 30 of the main chamber, defines an upper end of a combustion chamber 36, and provides a mounting point for a head switch 38, a spark plug 40, an electric fan motor 42, and a sealing O-ring 44.

A combustion chamber fan 46 is attached to an armature 48 of the motor 42 and is located within the combustion chamber to enhance the combustion process and to facilitate cooling and scavenging. The fan motor 42 is controlled by the head switch 38, as disclosed in more detail in the prior patents incorporated by reference.

A generally cylindrical, reciprocating valve member 50 is moved within the main chamber 14 by a workpiece contact element 52 on the nosepiece 26 using a linkage 54 in a known manner. The linkage 54 is considered part of the workpiece contact element 54. The valve member 50 serves as a gas control device in the combustion chamber 36, and sidewalls of the combustion chamber arc defined by the valve member, the upper end of which sealingly engages the O-ring 44 to seal the upper end of the combustion chamber (best seen in FIG. 2). A lower portion 56 of the valve member 50 circumscribes a generally cylindrical cylinder body or cylinder 58. An upper end of the cylinder body 58 is provided with an exterior O-ring 60 which engages a corresponding portion 62 of the valve member 50 (best seen in FIG. 2) to seal a lower end of the combustion chamber 36.

Within the cylinder body 58 is reciprocally disposed a piston 64 to which is attached a rigid, elongate driver blade 66 used to drive fasteners (not shown), suitably positioned in the nosepiece 26, into a workpiece (not shown). A lower end of the cylinder body defines a seat 68 for a bumper 70 which defines the lower limit of travel of the piston 64. At the opposite end of the cylinder body 58, a piston stop retaining ring 72 is affixed to limit the upward travel of the piston 64.

Located in the handle portion 20 of the housing 12 are the controls for operating the tool 10. A trigger switch assembly 74 includes a trigger switch 76, a trigger 78 and a biased return member 80, which in the preferred embodiment is a coiled spring. An electrical control unit 82 under the control of the trigger switch 76 activates the spark plug 40.

The operation of the trigger 78 between an OFF position (FIG. 1) and an ON position (FIG. 2) is controlled by a cam interlock or trigger lockout mechanism, generally referred to as 84, which prevents actuation of the trigger until the tool 10 is pressed against a workpiece. Such pressure causes the nosepiece 26 to be depressed, causing the linkage 54 to move the valve member 50 upward to close the combustion chamber 36 and seal it from the atmosphere.

More specifically, and referring now to FIGS. 1–4, the lockout mechanism 84 includes a trigger bracket 86 which is secured at one end to the trigger 78 and at the other, has an angled arm 88 which is provided with a transverse pivot pin 90.

Engaged on the pin 90 is a generally triangular-shaped releasing cam 92 provided with an open ended slot 94 dimensioned to slidingly engage the pin 90. Also provided to the cam 92 is a throughbore 96 which matingly engages a pivot bushing 98, and a cam lobe 100. Referring now to FIG. 1, the cam lobe 100 engages an end of a generally U-shaped rod 102 when the combustion chamber 36 is open to the atmosphere. This engagement prevents the depression of the trigger 78, and thus prevents ignition.

Referring now to FIG. 2, since the U-shaped rod 102 is attached to the valve member 50, as the combustion chamber 36 is closed by the valve member, the rod 102 moves upward with the valve member, which creates a clearance for the movement of the releasing cam 92 past the rod. With the cam 92 free to move, the trigger 78 can be depressed to cause ignition. This lockout mechanism 74 is described in greater detail in commonly-assigned U.S. Pat. No. 4,483,474.

As the trigger 78 is pulled, a signal is generated from the central electrical distribution and control unit 82 to cause a discharge at the spark gap of the spark plug 40, which ignites the fuel which has been injected into the combustion chamber 36 and vaporized or fragmented by the fan 46. This ignition forces the piston 64 and the driver blade 66 down the cylinder body 58, until the driver blade contacts a fastener and drives it into the substrate as is well known in the art. The piston then returns to its original, or "ready" position through differential gas pressures within the cylinder, which are maintained in part by the sealed condition of the combustion chamber. If the combustion chamber 36 is opened before the piston returns to its start position, seen in FIGS. 1 and 2, then this differential gas pressure relationship is destroyed, which interferes with the return of the piston.

It has been found that with high energy combustion powered tools having a relatively longer cylinder body 58 or larger combustion chamber, additional time is required for the piston 64 to return to the start position, seen in FIGS. 1 and 2. In these models, the potential exists, upon release of the trigger 78, for the combustion chamber to be prematurely opened. It will be seen from FIGS. 1 and 2 that as long as the trigger 78 is depressed, the U-shaped rod 102 cannot move downward to release the valve member 50 from its position sealing the combustion chamber. However, once the trigger 78 is released, the cam 92 moves to the position of FIG. 1 and permits the rod 102 to move downward, opening the combustion chamber.

As stated above, it is important that the combustion chamber 36 not be opened before the piston has returned to the start position. Thus, an important feature of the present invention is the provision of a delay apparatus for retarding the opening of the combustion chamber. In a preferred embodiment, this is accomplished by retarding the release of the trigger 78 from its depressed or ON position, until the piston 64 fully returns.

Figure 3:
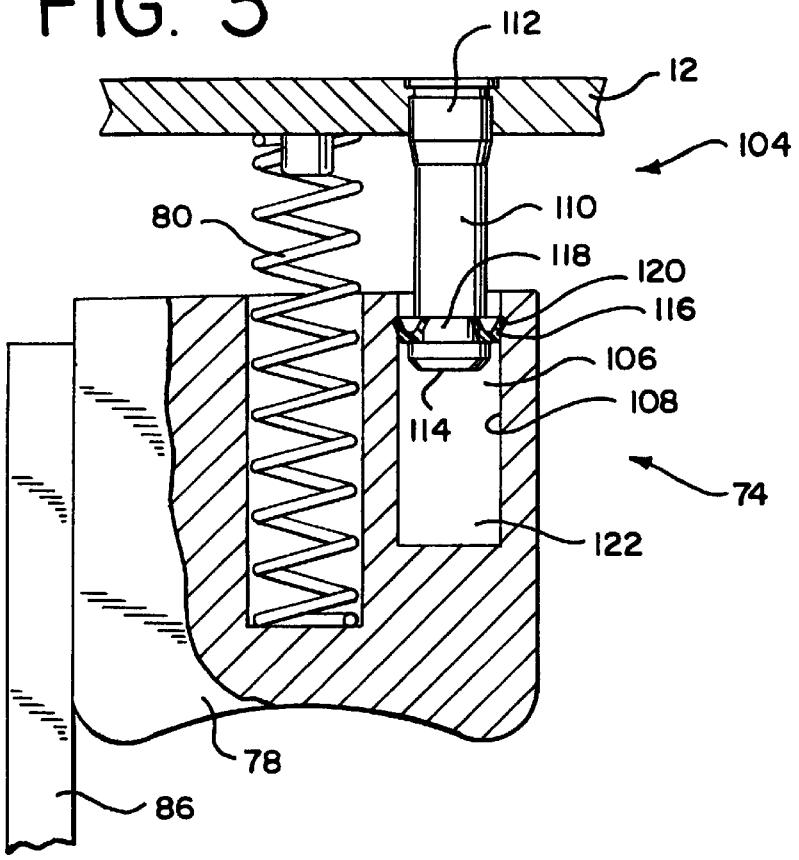
FIG. 3 is an enlarged, partially cut away view of the trigger assembly and the pneumatic delay valve of the present invention shown in the OFF position.
Figure 4:
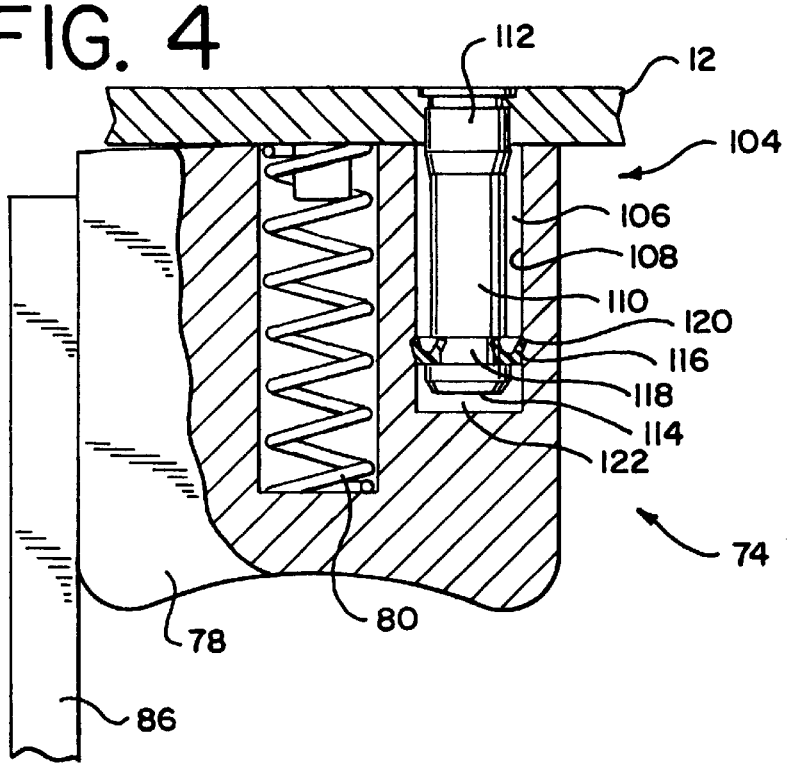
FIG. 4 is an enlarged partially cut away view of the trigger assembly and the pneumatic delay valve of FIG. 3 shown in the ON position.

Referring now to FIGS. 3 and 4, the delay apparatus of the invention is generally designated 104, and, in the preferred embodiment, features a pneumatic check valve configured for delaying the action of the biased return member or coil spring 80 which returns the trigger 78 to the released or OFF position shown in FIG. 3. The pneumatic check valve includes a cavity 106 defined by generally cylindrical inside wall 108 located within the trigger 78. A plunger 110 is fixed at a base end 112 to a support formation in the housing 12 by a friction fit, a threaded fastener or other known fastening technology. At the opposite end or tip 114, the plunger 110 matingly engages the cavity 106.

In the preferred embodiment, the plunger 110 is equipped with a sealing member 116 secured within an annular groove 118 located near the tip 114. A friction fit and/or chemical adhesives may be used to secure the sealing member 116 in place. The sealing member 116 is preferably a so-called "U-cup" seal, which has an outer lip 120 projecting at an oblique angle relative to the longitudinal axis of the plunger 110 to form a barb or arrowhead-type configuration. Thus, the lip 120 wipingly engages the inside wall 108 of the cavity 106, and creates friction which counters the action of the biased return member 80 and delays the return of the trigger 78 to the OFF position. In other words, the sealing member 116 is disposed on the plunger 110 so that the trigger is easy to pull to the ON position (FIG. 4), but is slower in its return to the OFF position (FIG. 3).

When the trigger 78 is depressed, the movement of the trigger over the plunger 110 forces a substantial amount of the residual air from the cavity 106, creating a relative vacuum in the region 122 of the cavity behind the sealing member 116. Due to inherent imperfections in the sealing member 116, which is preferably made of buna-N or butyl rubber or equivalent, this vacuum is not complete, and, as a result of the force applied by the biased return member 80, the air will slowly leak into the region 122, thus permitting the spring 80 to push the trigger 78 to return to the OFF position. Skilled practitioners will appreciate that the sealing member 116 must not be made so as to create a total seal, for that would create a vacuum which would prevent the return of the trigger 78 to the OFF position. In some applications, the lip 120 may be coated with grease to cause it to slide easier in the cavity 106.

In the preferred embodiment, the plunger 110 and the cavity 106 are so dimensioned that the vacuum created in the region 122 is sufficient to delay the trigger 78 reaching the OFF position until the piston 64 returns to the start position. It has been found that the incorporation of the present delay apparatus 104 into the tool 10 has generally doubled the time required to return the trigger 78 to its OFF position when compared with more conventional combustion powered tools. When equipped with the present delay apparatus, the time required for the trigger 78 to reach the OFF position from the ON position is approximately 200 milliseconds.

Figure 6:
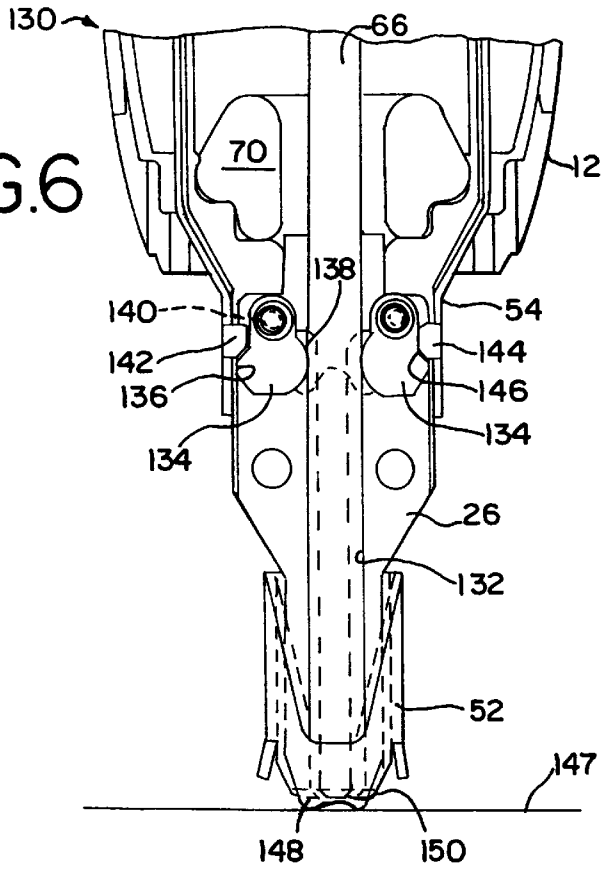
FIG. 6 is a view of the tool shown in FIG. 5 shown in the firing position.
Figure 5:
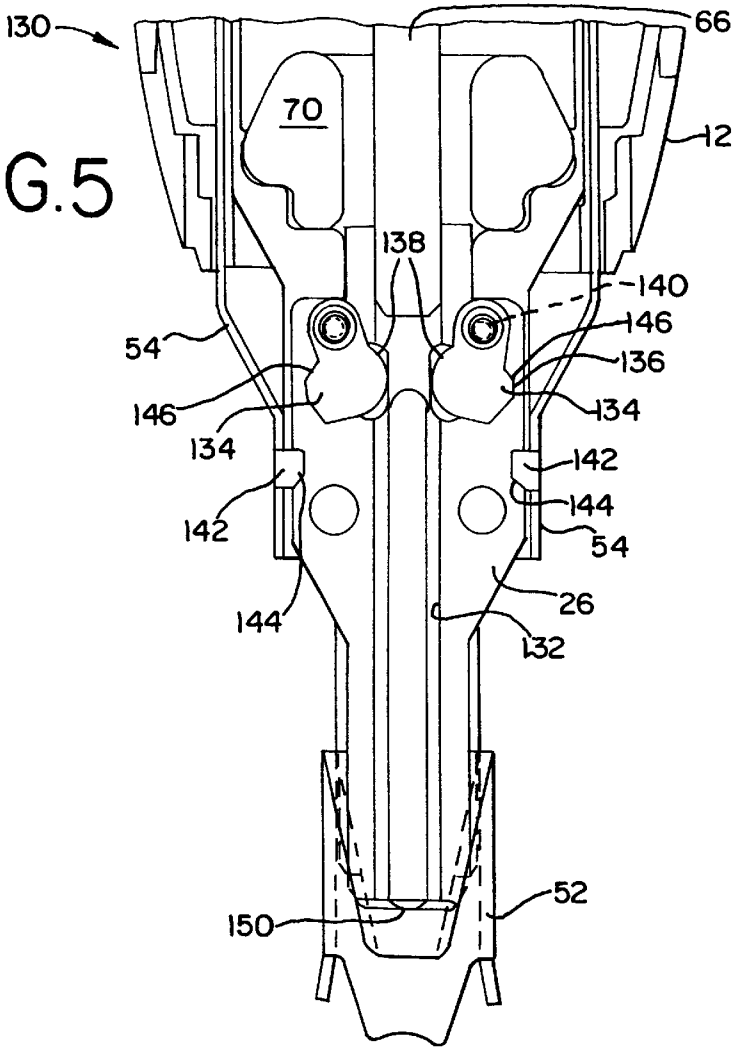
FIG. 5 is a fragmentary rear view of a nosepiece of the tool of FIGS. 1 and 2 in which is incorporated an alternate embodiment of the lockout system, the tool being shown in the rest position.

Referring now to FIGS. 5 and 6, an alternate embodiment to the tool 10 is generally designated 130, and shared components are designated with identical reference numbers. FIGS. 5 and 6 depict enlarged fragmentary rear elevational views of the nosepiece region of the tool 130. In this embodiment, the nosepiece 26 is provided with an axial recessed track 132 which slidingly receives the driver blade 66 as it reciprocates with each firing. One important differentiating feature of the tool 130 is that the nosepiece 26 is provided with a device for securing the workpiece contact element 52 relative to the nosepiece until the piston 64 has reached the start position. In the preferred embodiment, this device takes the form of at least one and preferably two cams 134 pivotally engaged on the nosepiece 26. Each cam 134 has a first or outer lobe 136 for engaging the workpiece contact element 52, and a second, or inner lobe 138 for engaging the driver blade 66. Both cams 134 are freely pivotally secured to the nosepiece 26 by pins 140. Both cams 134 need to be dimensioned so that they are wide enough to place the lobes 136, 138 in engagement with the appropriate component 52, 66.

Another differentiating feature of the tool 130 is that the workpiece contact element 52 is provided with at least one and preferably a pair of tabs 142 which are configured for engaging the lobes 136 in such a way that, upon engagement, the contact element 52, cannot move relative to the nosepiece 26 until the lobes 136 disengage from the tabs 142. Since the contacting element 52 is connected to the valve member 50 through the linkage 54, this engagement prevents the valve member 50 from opening until the piston 64 reaches the start position.

More specifically, the tabs 142 each have an angled leading edge 144 which nests upon an opposing surface 146 of the lobes 136. The lobe dimensions are sufficiently radiused to enhance the relative sliding action between the tabs 142 and the lobes upon release through the passage of the driver blade 66. The cams 134 are configured so that once the tabs 142 are engaged upon the lobe surfaces 144, as the driver blade 66 descends along the track 132 and engages the lobes 138, a wedged arrangement is created whereby the cams 134 prevent the workpiece contact element 52 from moving, and the valve member 50 from opening the combustion chamber, until the driver blade has retracted or ascended past the cams 134.

In operation, in a rest position depicted in FIG. 5, the workpiece contact element 52 is disposed in an extended position relative to the nosepiece 26, signifying that the combustion chamber 36 is open due to the valve member 50 being connected to the extended element 52 via the linkage 54. In addition, the driver blade 66 is in a fully retracted position due to the piston 64 being in its start position. It will also be appreciated that the tabs 142 are disposed below the cams 134, which, in this position, are not engaged by the tabs 142 or the driver blade 66, and pivot freely.

Referring now to FIG. 6, the operator has pressed the tool 130 against the workpiece 147 in preparation for firing. As such, a lower end 148 of the workpiece contact element 52 is in contact with the workpiece 147, and a lower end 150 of the nosepiece 26 is closely adjacent the end 148. This means that the linkage 54 has caused the valve member 50 to move upward relative to the housing 12, closing the combustion chamber 36. At the same time, the tabs 142 on the workpiece contact element 52 have moved from a position below the cams 134 (best seen in FIG. 5) to a position above the cam lobes 136, 138 (best seen in FIG. 6). The tool 130 may then be fired, as described above in relation to the tool 10.

Upon firing, the piston 64 is pushed downward, causing edges of the driver blade 66 to slidingly engage the inner lobes 138. This engagement creates a wedged relationship between the driver blade 66, the cams 134 and the tabs 142, forcing the angled leading edge 144 of the tab 142 in tight engagement with the cam surface 146. In this position, if the tool 130 is lifted from the workpiece 147, as occurs in bump firing, the valve member 50 cannot open the combustion chamber 36 because the workpiece contact element 52 cannot move at all. This lockout condition keeps the combustion chamber 36 sealed until the piston 64 can return to the start position due to differential gas pressures created within the tool.

Once the piston returns to the start position, represented by the uppermost position of the driver blade 66, the drive blade is no longer in engagement with the inner lobes 138, and the pivoting cams 134 are free to move away from the tabs 142 on the workpiece contact element 52. The valve member 50, which is spring biased to the open position, then pushes the outer lobes 136 inward, allowing the valve member to open, so that the combustion chamber 36 can be purged of exhaust gases and readied for another firing.

Figure 7:
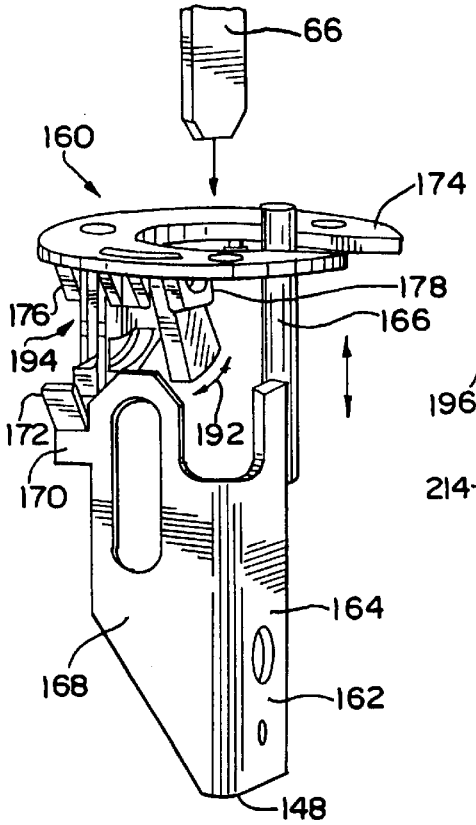
FIG. 7 is a fragmentary perspective view of another alternate embodiment of the present lockout system.
Figure 8:
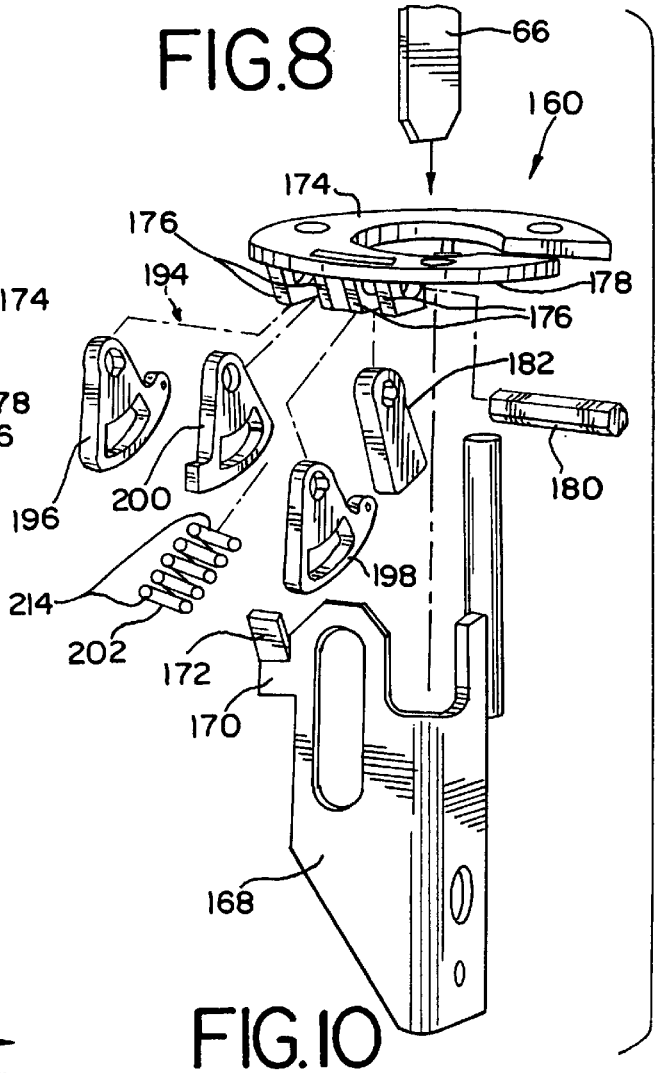
FIG. 8 is a fragmentary exploded perspective view of the system of FIG. 7.

Referring now to FIGS. 7 and 8, yet another alternate embodiment of the tool 10 is generally designated 160, with shared components being designated with the same reference numbers. In general, the tool 160 incorporates the same feature of the tools 10 and 130, that being that the combustion chamber 36 cannot open until the piston 64 returns to the start position. Like the tool 130, the tool 160 achieves this goal by securing the workpiece contact element relative to the nosepiece 26 until the driver blade 66 is fully retracted.

More specifically, the workpiece contact element 162 is formed into a 90° angle, and has a first panel 164 to which is attached the valve linkage 166, and a second panel 168 provided with a latch tab 170 with an angled upper portion 172. In the preferred embodiment, the lower end 148 of the workpiece contact element 162 is disposed on the first panel 164, but it is also contemplated that the element 162 could be configured so that the lower end 148 is located on the second panel 168.

Figure 9:
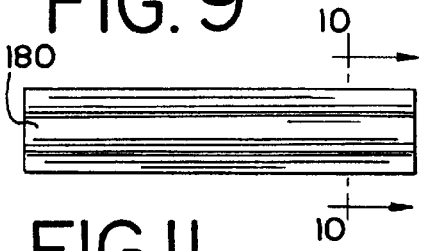
FIG. 9 is a front elevational view of the pivot shaft shown in FIG. 8.
Figure 10:
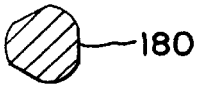
FIG. 10 is a section taken along the line 10—10 of FIG. 9 and in the direction generally indicated.
Figure 11:
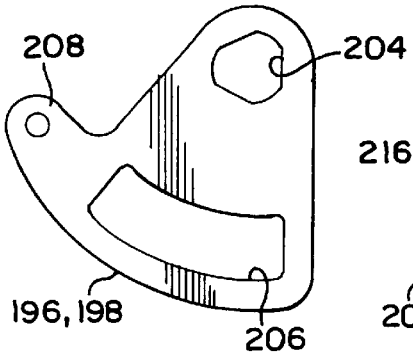
FIG. 11 is an overhead plan view of an outer cam plate of the tool of FIG. 7.
Figure 12:
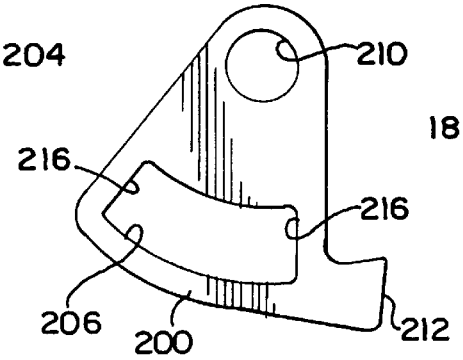
FIG. 12 is an overhead plan view of an inner cam plate of the tool of FIG. 7.
Figure 13:
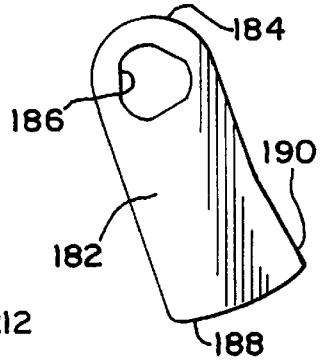
FIG. 13 is an overhead plan view of a driver blade latch member of the tool of FIG. 7.

A mounting plate 174 is configured to be mountable upon a lower end of the housing 12, and also has at least four depending spaced eyelets 176. The eyelets 176 each have a throughbore 178, and the throughbores are all in registry with each other. A connecting shaft 180 (best seen in FIGS. 9 and 10) is non-circular in cross section and is configured to be rotatably received in each of the throughbores 178. Connected to the shaft 180 is a generally planar driver blade latch member 182 (best seen in FIG. 13) having a first end 184 with a non-circular throughbore 186 configured to matingly engage the shaft 180 to rotate therewith, and a second, opposite end 188 having a flared formation 190 for engaging the driver blade 66. The driver blade latch member 182 is preferably located between a pair of the eyelets 176 so that when the driver blade 66 descends to engage a fastener, the flared formation 190 is engaged by the driver blade and is pivoted upon (and with) the shaft 180 away from the driver blade as reflected by the arrow 192 (FIG. 7).

Referring now to FIGS. 7, 8, 11 and 12, a tab latch 194 is disposed between a second pair of eyelets 176 and is engaged on the shaft 180 to move with the shaft when the driver blade latch member 182 is engaged by the driver blade 66. Four main components make up the tab latch 194: a pair of identical outer cam plates 196, 198, an inner cam plate 200 and a coiled spring 202.

Each of the outer cam plates 196, 198 (best seen in FIG. 11) is generally triangular in shape, having a non-circular throughbore 204 configured for matingly engaging the shaft 180, an arcuate spring opening 206 and a spring attachment eyelet 208. In the preferred embodiment, the spring attachment eyelet projects 208 laterally along a side of the plate generally along the arc defined by the arcuate spring opening 206, but other configurations are contemplated depending on the application. The inner cam plate 200 is similar in overall configuration to the outer cam plates 196, 198, but differs in two main areas. First, a throughbore 210 is circular, and as such will rotate independently of the shaft 180, which it engages. Second, instead of a spring attachment eyelet 208, the inner cam plate 200 has a lug 212 extending from the opposite side edge of the plate as the eyelet 208.

A spring opening 206 is also provided to the inner cam plate 200. The spring 202 is disposed in the spring opening 206 of the inner cam plate 200 so that ends 214 of the spring engage edges 216 of the opening 206. In the preferred embodiment, the spring 202 has a diameter dimensioned so that when the plates 196, 198 and 200 are assembled in sandwich form (best seen in FIG. 7), with the inner cam plate disposed between the two outer cam plates, the spring will extend into the respective spring opening 206 of both the outer cam plates. In its relaxed position, the spring 202 will basically extend end-to-end in each of the openings 206 to bias the inner cam plate 200, and particularly the lug 212, toward the locking tab 170. In the event that a load is placed on the lug 212, as will be described below, which causes the inner cam plate 200 to pivot relative to the outer cam plates 196, 198 in the direction towards the driver blade 66, the spring 202 will be compressed, and will urge the inner cam plate to return to its original position upon release of the load.

A return spring 218 (best seen in FIG. 14A) is connected at a first end to both of the spring attachment eyelets 208, and at another end to a pin 220 depending from the mounting plate 174. The spring 218 is configured to return the cam plates 196, 198, 200 to their "at rest" position in disengagement from the locking tab 170 on the workpiece contact element 162 upon retraction of the driver blade 66 once the piston attains the start position.

In operation, and referring now to FIGS. 14A–F, the tool 160 is first shown in the start position (FIG. 14A), with the driver blade 66 retracted and the piston (not shown) in the start position. The return spring 218 is pulling the tab latch 194, including the plates 196, 198, 200 out of engagement with the locking tab 170, and the spring 202 is holding the plates 196, 198, 200 in registry, or general alignment with each other. Also, it should be noted that the locking tab 170 is shown below the lug 212 on the inner cam plate 200, which signifies that the workplace contact element 162 is in the extended position, indicating that the combustion chamber 36 is open.

Figures 14A, 14B, 14C, 14D, 14E, 14F:
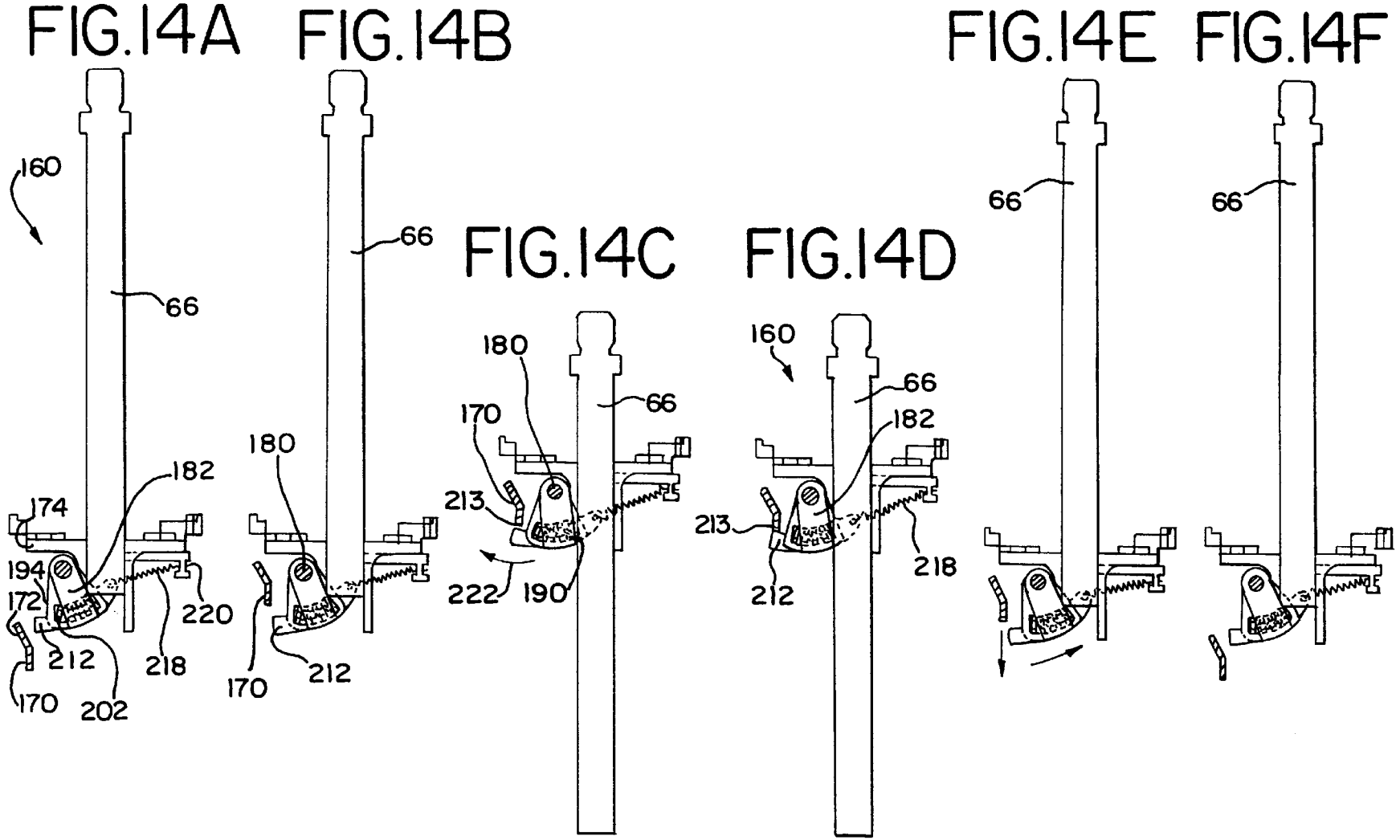
FIGS. 14A–F are schematic front views of the sequence of normal operation of another embodiment of the present tool.

In arrangement on the mounting plate 174, the driver blade latch member 182 and the tab latch 194 are disposed relative to each other so that the driver blade latch member 182 is engageable by the driver blade 66, and the tab latch 194 is engageable with the locking tab 170. Referring now to FIG. 14B, the operator has pressed the tool 160 against the workpiece so that the workpiece contact element has moved upward (see new position of the tab 170) and the combustion chamber 36 has been sealed by the valve member 50. Note that the tab 170 is totally above the lug 212. The tool 160 is now ready for firing.

Referring now to FIG. 14C, the tool 160 has been fired, and the driver blade 66 has descended to engage a fastener. In its descent, the driver blade 66 has engaged and pushed aside the flared formation 190 of the driver blade latch member 182, and accordingly caused the rotation of the member 182, the shaft 180 and the tab latch 194 in a clockwise direction, as seen by the arrow 222. This position will be referred to as the displaced or rotated position of the member 182 and the latch 194. Note that, in its rotated position, the lug 212 of the tab latch 194 blocks any downward movement of the locking tab 170.

Referring now to FIG. 14D, the operator has now lifted the tool 160 from the workpiece surface, in a so-called "bump firing" movement to quickly move the tool to the next firing position. As such, the workpiece contact element 162 is no longer constrained by the workpiece, and attempts to return to the rest position of FIG. 14A. However, the lug 212 prevents that movement by engaging an edge 213 of the locking tab 170, which also keeps the combustion chamber 36 sealed by preventing unwanted movement of the valve member 50.

In FIG. 14E, the driver blade 66 is fully retracted, and the driver blade latch member 182 is then returned to its start position by the return spring 218, which, by movement of the tab latch 194, also moves the driver blade latch member via the shaft 180. Next, the workpiece contact element 162 is now free to move downward, thus opening the combustion chamber 36 to permit purging of combustion gases from the combustion chamber (FIG. 14F). FIGS. 14A and 14F are identical, and the tool 160 is now prepared for another firing.

Figures 14G, 14H, 14I, 14J, 14K, 14L:
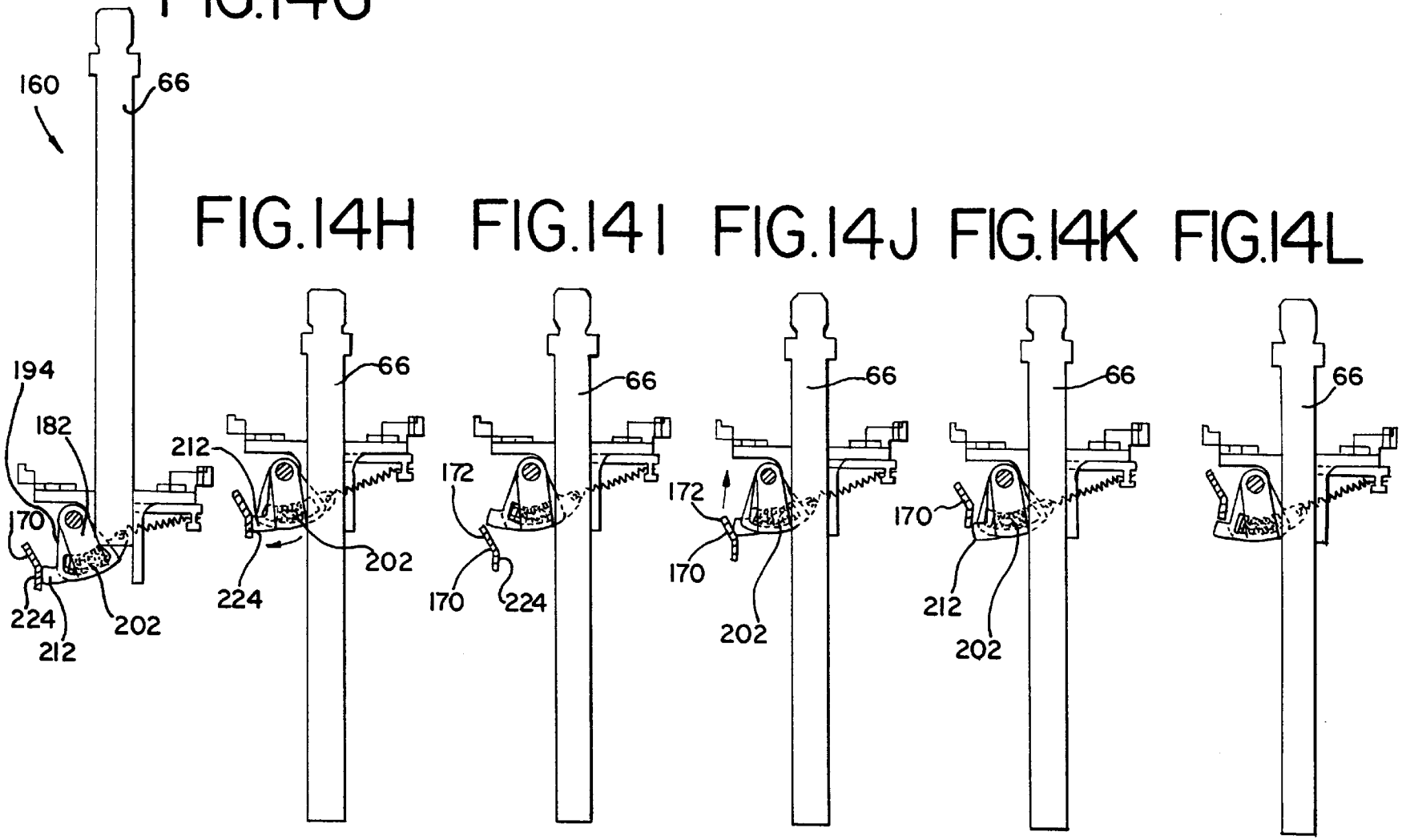
FIGS. 14G–L are schematic front views of the sequence of abnormal operation of the tool of FIGS. 14A–F.

Referring now to FIGS. 14G–14L, it will be seen that the tool 160 is designed to prevent jamming through the operation of the tab latch 194. In FIG. 14G, the driver blade 66 is shown in the start position, but the workpiece contact element 162 has not yet reached the fully retracted or closed position, so that the lug 212 has engaged a side surface 224 of the locking tab 170. As seen in FIG. 14H, even though the combustion chamber 36 is not fully closed, the tool 160 has been fired, causing the driver blade 66 to push the driver blade latch member 182 out of the way, and also moves the tab latch 194 in a clockwise direction due to the connection via the shaft 180. However, the engagement of the lug 212 with the surface 224 prevents the tab latch from reaching its full clockwise displacement. If there were no release mechanism, the driver blade would be prevented from freely descending to drive the fastener, as well as not properly returning to the start position. Thus, to relieve this situation, the inner cam plate 200 is movable relative to the outer cam plates 196, 198 due to its having the circular throughbore 210 (best seen in FIG. 12). Also, the spring 202 compresses, allowing the driver blade 66 to properly clear the latch member 182.

A related problem is shown in FIG. 14I, which, because of the lack of a fully closed combustion chamber during the firing, there is an insufficient or even nonexistent differential of gas pressures which normally allow the piston to return to the start position. Through the compression of the spring 202 shown in FIG. 14H, the locking tab 170 will be able to pass the lug 212, and descend, a movement which is facilitated by the angled upper portion 172 of the tab 170.

Referring now to FIGS. 14J and 14K, the tool 160 cannot be refired since the driver blade 66 is already in the lowered position. To reset the tool, which is not jammed, but the parts merely out of proper position, the operator presses the nosepiece 26 and the workpiece contact element 162 against the workpiece 147. This action pushes the workpiece contact element 162 upward, but because the driver blade 66 is down, the tab latch 194 is still in the displaced or rotated position, and the workpiece contact element cannot move its full distance upward.

To allow the element 162 to pass the lug 212, the angled portion 172 of the locking tab 170 begins a camming action which compresses the spring 202. With additional downward pressure by the operator, the locking tab 170 sufficiently compresses the spring 202 to move the lug 212 and the inner cam plate 200 in a counterclockwise direction until sufficient clearance is provided to allow the workpiece contact element 162 to pass the lug 212.

Referring now to FIG. 14L, it will be seen that the tab 170 of the workpiece contact element 162 has cleared the lug 212, and the valve member 50 has reached the start position where the combustion chamber 36 is typically closed. However, the chamber is not closed in this instance, because the piston 64 is still in its lowermost or fired position, and has not returned to the start position due to the combustion chamber being open.

Since the driver blade 66 is depressed, the driver blade latch member 182 and the tab latch 194 are still in the rotated or displaced position. To prepare the tool 160 for firing, the operator resets the driver blade 66 with a screw driver or similar tool by pushing the driver blade upward into the housing 12, until it reaches the start position (best seen in FIG. 14A). At that time, the latch member 182 and the tab latch 194 will be pulled to the position of FIG. 14A by the return spring 218. The tool 160 can then be refired once the tool is placed upon a workpiece 147 and depressed to close the combustion chamber as shown in FIG. 14B.

Thus, it will be seen that the present delay mechanism, in the form of the trigger delay 104, the pivoting cams 134 or the combination of the driver blade latch member 182 and the tab latch 194, ultimately delays the opening of the combustion chamber 36 until the piston 64 reaches the start position. Thus, more reliable operation of the tool is achieved, and the operator may more efficiently manipulate the tool by bump firing where desired. It will be appreciated that other mechanisms known to skilled practitioners may be utilized to maintain the combustion chamber closed until the piston reaches the start position, and still be within the scope of the present invention.

While a particular embodiment of the combustion chamber delay for a combustion-powered tool of the invention has been shown and described, it will be appreciated by those skilled in the art that changes and modifications may be made thereto without departing from the invention in its broader aspects and as set forth in the following claims.

What is claimed is:

1. A combustion powered tool having a self-contained internal combustion power source constructed and arranged for creating a combustion for driving a driver blade to impact a fastener and drive it into a workpiece, comprising:

a housing constructed and arranged to enclose the power source;

a combustion chamber defined at an upper end of said housing;

a cylinder disposed in said housing to be in fluid communication with said combustion chamber;

a valve member disposed in said housing to periodically open and close said combustion chamber;

a piston associated with the driver blade and configured for reciprocal movement within said cylinder between a start position located at a first end of said cylinder and a driving position located at a second end of said cylinder;

a nosepiece having a workpiece contact element connected to said valve member and configured for contacting a workpiece into which a fastener is to be driven, said workpiece contact element being movable relative to said nosepiece, and upon said contact, such movement of said workpiece contact element causing said valve member to close said combustion chamber; and delay means actuated and engageable by said driver blade as it descends to impact the fastener, and with said workpiece contact element, so that said delay means prevents said workpiece contact element from moving relative to said nosepiece and said valve from opening said combustion chamber while said driver blade engages said delay means for delaying the opening of said combustion chamber by said valve member until said piston returns to said start position after driving the fastener.

2. The tool as defined in claim 1, wherein said delay means includes a trigger switch assembly in said housing having a trigger operating between an ON and an OFF position, said delay means including a lockout mechanism operationally connected between said valve member and said trigger and being configured for delaying the movement of said trigger from said ON position to said OFF position until said piston returns to said start position.

3. The tool as defined in claim 2, wherein said trigger switch assembly includes said trigger, a trigger switch, a biased return member, and a pneumatic check valve configured for delaying the action of said biased return member.

4. The tool as defined in claim 3, wherein said pneumatic check valve includes a cavity with inside walls located in said trigger, a plunger fixed to said housing and matingly engaged in said cavity, said plunger having a sealing member for wipingly engaging said inside walls so that the engagement of said sealing member with said cavity creates friction which counters the action of said biased return member and delays the return of said trigger to said OFF position.

5. The tool as defined in claim 1 wherein said delay means include lockout means configured for securing said workpiece contact element relative to said nosepiece until said piston has reached the start position.

6. The tool as defined in claim 5 wherein said lockout means includes at least one cam pivotally engaged on said nosepiece and having a first lobe for engaging said workpiece contact element and a second lobe for engaging said driver blade.

7. The tool as defined in claim 6 wherein said workpiece contact element includes at least one tab for engaging a corresponding one of said at least one first lobe.

8. The tool as defined in claim 5 wherein said lockout means include a locking tab on said workpiece contact element, a first latch member engageable by said driver blade as it descends to impact the fastener, and a second latch member configured for movement with said first latch member and for engaging said locking tab to prevent said valve member from moving to open said combustion chamber until the piston reaches the start position.

9. The tool as defined in claim 8 wherein said first latch member is a driver blade latch member engageable by said driver blade as it descends to impact the fastener, and said second latch member is a tab latch configured for engaging an edge of said locking tab to prevent said valve member from moving to open said combustion chamber until the piston reaches the start position.

10. The tool as defined in claim 9 wherein said tab latch is configured to have an overload feature provided by a pair of outer cam plates and an inner cam plate having a lug for engaging said locking tab, said inner cam plate being sandwiched between said outer cam plates, and being biased toward said locking tab.

11. The tool as defined in claim 10 wherein said inner cam plate is configured so that upon engagement with a side of said locking tab, said inner plate can move against the bias toward said tab and retract, allowing passage of said driver blade without jamming the tool.

12. The tool as defined in claim 10 wherein said outer cam plates are biased away from said locking tab, so that upon said piston reaching said start position, said cam plates move away from said locking tab.

13. A combustion powered tool having a self-contained internal combustion power source constructed and arranged for creating a combustion for driving a driver blade to impact a fastener and drive it into a workpiece, comprising:

a housing constructed and arranged to enclose the power source;

a combustion chamber defined at an upper end of said housing;

a cylinder disposed in said housing to be in fluid communication with said combustion chamber;

a valve member disposed in said housing to periodically open and close said combustion chamber;

a piston associated with the driver blade and configured for reciprocal movement within said cylinder between a start position located at a first end of said cylinder and a driving position located at a second end of said cylinder;

a nosepiece having a workpiece contact element connected to said valve member and configured for contacting a workpiece into which a fastener is to be driven, said workpiece contact element being movable relative to said nosepiece, and upon said contact, such movement of said workpiece contact element causing said valve member to close said combustion chamber; and lockout means actuated and engageable by said driver blade as it descends to impact the fastener, and configured for securing said workpiece contact element relative to said nosepiece and preventing said valve member from opening said combustion chamber until said piston has reached the start position, said lockout means including at least one cam pivotally engaged on said nosepiece and having a first lobe for engaging said workpiece contact element and a second lobe for engaging said driver blade, so that as said driver blade descends to contact a fastener, said at least one cam member engages said workpiece contact element with said first lobe and said driver blade with said second lobe to prevent movement of said valve element until said piston returns to the start position.

14. A combustion powered tool having a self-contained internal combustion power source constructed and arranged for creating a combustion for driving a driver blade to impact a fastener and drive it into a workpiece, comprising:

a housing constructed and arranged to enclose the power source;

a combustion chamber defined at an upper end of said housing;

a cylinder disposed in said housing to be in fluid communication with said combustion chamber;

a valve member disposed in said housing to periodically open and close said combustion chamber;

a piston associated with the driver blade and configured for reciprocal movement within said cylinder between a start position located at a first end of said cylinder and a driving position located at a second end of said cylinder;

a nosepiece having a workpiece contact element connected to said valve member and configured for contacting a workpiece into which a fastener is to be driven, said workpiece contact element being movable relative to said nosepiece, and upon said contact, such movement of said workpiece contact element causing said valve member to close said combustion chamber; and a lockout assembly including a lockout tab on said workpiece contact element, a pivotable driver blade latch member actuated and engageable by said driver blade as it descends to impact the fastener, and a tab latch member configured for pivotal movement with said driver blade latch member, said tab latch configured for engaging said tab, so that while said tab latch member is engaged with said tab, said workpiece contact element is secured relative to said nosepiece and said valve member is prevented from moving to open said combustion chamber until said piston returns to the start position.

15. The tool as defined in claim 14 wherein said tab latch is configured to have an overload feature provided by a pair of outer cam plates and an inner cam plate having a lug for engaging said tab, said inner cam plate being sandwiched between said outer cam plates, and being biased toward said tab.

16. The tool as defined in claim 15 wherein said inner cam plate is configured so that upon engagement with a side of said tab, said inner plate can move against the bias toward said tab and retract, allowing passage of said driver blade without jamming the tool.

17. The tool as defined in claim 15 wherein said outer cam plates are biased away from said tab, so that upon said piston reaching said start position, said cam plates move away from engagement with said locking tab.

* * * * *